United States Patent [19]

Flowers et al.

[11] Patent Number: 4,751,958

[45] Date of Patent: Jun. 21, 1988

[54] CONTINUOUS CASTING ALUMINUM ALLOY

[75] Inventors: John E. Flowers, Riverside; Christopher A. Romanowski, Lake Arrowhead; Dennis M. Smith, Crestline, all of Calif.

[73] Assignee: Hunter Engineering Company, Inc., Riverside, Calif.

[21] Appl. No.: 929,330

[22] Filed: Nov. 10, 1986

Related U.S. Application Data

[63] Continuation-in-part of Ser. No. 783,957, Oct. 4, 1985, Pat. No. 4,681,152.

[51] Int. Cl.[4] ..... B22D 11/06; B22D 11/10

[52] U.S. Cl. ..... 164/473; 164/134; 164/477; 164/480

[58] Field of Search ..... 164/473, 480, 477, 134, 164/428

[56] References Cited

U.S. PATENT DOCUMENTS

| | | | |
|---|---|---|---|
| 2,790,216 | 4/1957 | Hunter | 164/480 |
| 3,405,757 | 10/1968 | Harvey et al. | 164/480 |
| 3,430,683 | 3/1969 | Hood, Jr. | 164/428 |
| 3,467,167 | 9/1969 | Mahin | 164/473 |
| 3,654,150 | 4/1972 | Eccles | 164/134 X |
| 3,757,847 | 9/1973 | Sofinsky et al. | 164/428 |
| 3,799,410 | 3/1974 | Blossey et al. | 164/428 X |
| 4,054,173 | 10/1977 | Hickam | 164/428 |
| 4,390,364 | 6/1983 | Yu | 75/67 |

FOREIGN PATENT DOCUMENTS

| | | | |
|---|---|---|---|
| 56-1253 | 1/1981 | Japan | 164/473 |
| 57-185961 | 11/1982 | Japan . | |
| 58-61950 | 4/1983 | Japan | 164/421 |

OTHER PUBLICATIONS

Bagshaw, M. J. et al.—"A Steady State Model for Roll Casting", Conference at Metal Casting at Santa Barbara, Calif., Jan. 1986.

Celtex Brochure from FOSECO, Inc.

Day, Paul et al., "Filtration of Irons With Cellular Ceramic Filters", In *Modern Casting*, Apr. 1984, Metaullics Brochure.

*Primary Examiner*—Nicholas P. Godici

*Assistant Examiner*—J. Reed Batten, Jr.

*Attorney, Agent, or Firm*—Christie, Parker & Hale

[57] ABSTRACT

A method is provided for continuously casting aluminum alloys having more than two percent total alloying elements by a combination of casting at thinner gauges and much higher speeds than usual. Since remelting in the caster is avoided, sheet quality is vastly improved, surface ripples are avoided, and casting rate increased as much 50%. The method is characterized by the thickness of the cast sheet being in the range of from 4 to 5.8 millimeters and the casting rate being in the range of from 1.3 to 1.9 meters per minute. Chlorides in the molten metal are coalesced and oxides filtered to keep the inclusion rate in the cast sheet very low.

22 Claims, 2 Drawing Sheets

CONTINUOUS CASTING ALUMINUM ALLOY

RELATED APPLICATION

This application is a continuation-in-part of U.S. patent application Ser. No. 783,957, filed Oct. 4, 1985 and now U.S. Pat. No. 4,681,152 issued July 21, 1987.

FIELD OF THE INVENTION

This invention relates to a process for high production rate continuous casting of aluminum base alloys, with two percent or more of total alloying elements, and is particularly useful for magnesium containing alloys used for magnetic recording disk substrates.

BACKGROUND

The hard magnetic disks used as memory media for storage of data in computers require an extremely high quality aluminum alloy substrate. The substrate depends on production of an especially high quality aluminum alloy sheet commonly referred to as disk stock. The magnetic disk substrate is blanked from this sheet, then processed through various thermal flattening, machining, lapping, polishing, chemical and anodizing operations before being coated with a thin film of magnetizable material. For example, such coatings may be applied by electroless or electrolytic plating or sputtering of cobalt-phosphorus or cobalt-nickel-phosphorus alloys directly on the aluminum, alloy substrate, or by coating the substrate with iron oxide or other magnetic powder.

The magnetic transducer that reads and writes on such a disk "flies" within a micron or less of the rotating disk surface. An extremely high uniformity of surface is required to avoid crashes of such a flying head and to prevent dropouts of magnetic recorded data due to pinholes or the like in the recording film.

In recent years there has been an emphasis on producing disks with higher information density in order to increase their capacity. A higher density inherently necessitates a decrease in the area for each bit of magnetic information on the disk. The increased resolution requires decreasing thickness of the magnetizable film and reducing the distance from the flying head to the magnetizable film surface. These requirements can only be met on a surface which has minimal micro roughness and no asperities. Hence, a substrate material with excellent surface is a prerequisite.

The surface layers of the substrate must be mechanically, chemically and microstructurally homogeneous, thus assuring that after polishing and electrochemical treatments, the surface of the disk is extremely smooth and flat and has high magnetic uniformity. The surface layers should be free from defects, inclusions and segregation which may cause discontinuities in the surface topography or magnetic characteristics.

To make magnetic memories economically in commercial quantities, industrial scale melting and casting conditions must be used, and conventional aluminum plant rolling and heat treating equipment are important. The substrate must have suitable mechanical strength, corrosion resistance, modulus of elasticity, density, heat resistance and magnetic properties for reliable magnetic memory disks.

At present most disk stock is produced by classical methods involving casting of large direct chill ingots 300 to 600 millimeters thick and sufficiently wide to be rolled to sheet having a width of 1.1 meters. The cast ingot is hot rolled, followed by cold rolling and annealing operations to obtain the desired thickness and width.

Exemplary alloys for magnetic memory disk stock are 5082 with a magnesium content of about 4%, and 5086 having a magnesium content of about 4% and a manganese content of from 0.2 to 0.7%. These intentionally added alloying elements, along with some impurity elements typically present in the alloy, tend to form intermetallic compounds during the solidification process, the most prominent of these being various forms of Al-Fe-Mn and Mg-Si phases. Because of the relatively slow cooling rate with large ingots, the intermetallic compounds tend to be rather coarse with dimensions generally exceeding ten microns. These large intermetallic compound particles can be quite deleterious to the quality of a magnetic memory disk substrate. The intermetallic compounds are invariably harder than the aluminum alloy matrix and do not exhibit the same degree of plastic flow during rolling operations, hence they have a tendency to separate from the matrix, forming microscopic voids. The machining and lapping operations may leave the intermetallic particles as protuberances from the surface or may pull them out from the surface, leaving voids. Such surface particles or voids cause an electrochemical discontinuity which tends to disrupt the formation of a smooth, continuous anodic film during the electrochemical treatments. Discontinuities in the anodizing can be mimicked in the magnetic film applied to the substrate.

Grain refining materials can be added to the alloy used for casting of large ingots to produce a fine grain size. However, the intrinsically slow cooling rate produces a comparatively large dendrite arm spacing, allowing microsegregation to occur and producing microheterogeneity, particularly in the intermetallic compound distribution. This microsegregation is difficult to eliminate during subsequent processing and may result in uneven surface in the final disk substrate.

Another proposed technique for producing disk stock for magnetic media starts with continuous casting of aluminum alloy sheet. Techniques have been developed for continuously casting a variety of aluminum alloys into sheet less than 10 millimeters thick by introducing the metal through a pouring tip made of insulating material, into the nip of continuously rotating casting rolls which are water cooled, thereby freezing and somewhat hot rolling the cast sheet. This technique has proved rapid and economical for casting commercial purity aluminum sheet and a variety of aluminum alloy. However, continuous casting of aluminum alloys has not yet had an impact on the disk stock market.

The alloys of choice for making disk stock are 5082, 5086 and 5182 or the like. These alloys have proved particularly difficult to continuously cast with consistently high quality. No suitable technique has been developed for making production quantities of disk stock of these materials. Only narrow width, pilot plant scale quantities of metal have been produced. Even so, the method has been dependent on tight control of alloy chemistry, which would be difficult to achieve in production conditions. Intermetallic segregation remains a problem since the largest particles are still of sufficient size to either protrude from the surface or leave voids, which in either case disrupt the formation of the anodic and magnetic films during electrochemical treatment.

Most significantly, prior continuous casting techniques for these alloys have not produced a completely homogeneous surface structure in the cast strip. Fluctuations during the casting process result in heterogeneity which results in heterogeneity which results in a rippled appearance on the surface. Heterogeneity in the cast sheet may require a high temperature annealing treatment to ameliorate its effects.

Although particularly troublesome in making computer disk stock, the appearance of ripple on the surface of aluminum alloys can be quite troublesome when the alloys are used for other purposes, as well. Ripple seems to be a problem in many alloys having more than about 2% of alloying elements in the aluminum. It is not generally regarded as a problem with the 1000 series of wrought aluminum materials, which are effectively commercially pure aluminum having 99% or more aluminum.

The reason for appearance of ripple on continuously cast aluminum alloy sheet has not previously been understood. It has been known to be associated with appearance of contamination on the surface of the casting rolls. Efforts have been made to avoid the appearance of ripples by mounting wire brushes to continually scrape such contamination from the roll surfaces. This has not proved satisfactory since such mechanical abrasion of the roll surface may lead to sticking, where the cast aluminum sheet adheres to the roll surface, causing quite several damage to the sheet.

Surprisingly it is found that when casting aluminum alloys in practice of this invention, rippling can be avoided and quite substantial increases can be made in the output of the casting machine. This effect is obtained not only with the magnesium-bearing alloys but also with other continuously castable alloys having more than about 2% of total alloying ingredients.

SUMMARY OF THE INVENTION

There is, therefore, provided in practice of this invention an improved method for casting aluminum alloy having more than about 2% of alloying elements in the aluminum wherein the molten aluminum alloy is continuously introduced through an insulated pouring tip into the entrance to the nip of the rotating rolls and a cast sheet is continuously withdrawn from between the rolls. The method, according to a presently preferred embodiment, is characterized by the thickness of the cast sheet being in the range of from 4 to 5.8 millimeters, and the casting rate being more than 1.3 meters per minute. Preferably, the thickness of the cast sheet is in the range of from four to five millimeters, and the casting speed is in the range of from 1.5 to 1.9 meters per minute.

A variety of practices provide high quality cast sheet in accordance with such a process. Among other things, careful attention to filtering the alloy upstream from the caster to remove insoluble materials is important. The caster tip should be free from baffles on which insoluble materials can collect.

BRIEF DESCRIPTION OF THE DRAWINGS

These and other features and advantages of the present invention will be appreciated as the same becomes better understood by reference to the following detailed description when considered in connection with the accompanying drawings wherein.

DETAILED DESCRIPTION

The process provided in practiced of this invention may be conducted by way of a continuous roll caster of a type commonly used for casting aluminum-base alloys. Such an apparatus is described in U.S. Pat. No. 4,054,173 by Hickam, the subject matter of which is hereby incorporated by reference. In such an apparatus a pair of water-cooled, parallel casting rolls are positioned one above the other. These rolls are spaced apart a distance corresponding to the thickness of a sheet being cast. A pouring tip fits snugly into the converging space between the casting rolls on the entrance side. In an exemplary caster, each of the rolls is about one meter in diameter, and they have a length in the order of 1.5 meters. Preferably, the plane in which the roll axes lie is not vertical, but instead is tilted backward by about 15°; that is, the plane is tilted so that the upper roll is about 15° nearer the entrance side than the lower roll. The metal thus tends to move somewhat upwardly into the nip of the rolls. This is referred to as a tilt caster. A so-called horizontal caster has the rolls in a vertical plane with metal flowing horizontally into the nip of the rolls. Early casters for aluminum had the rolls in a horizontal plane with metal flowing vertically into the rolls.

Figure 1:
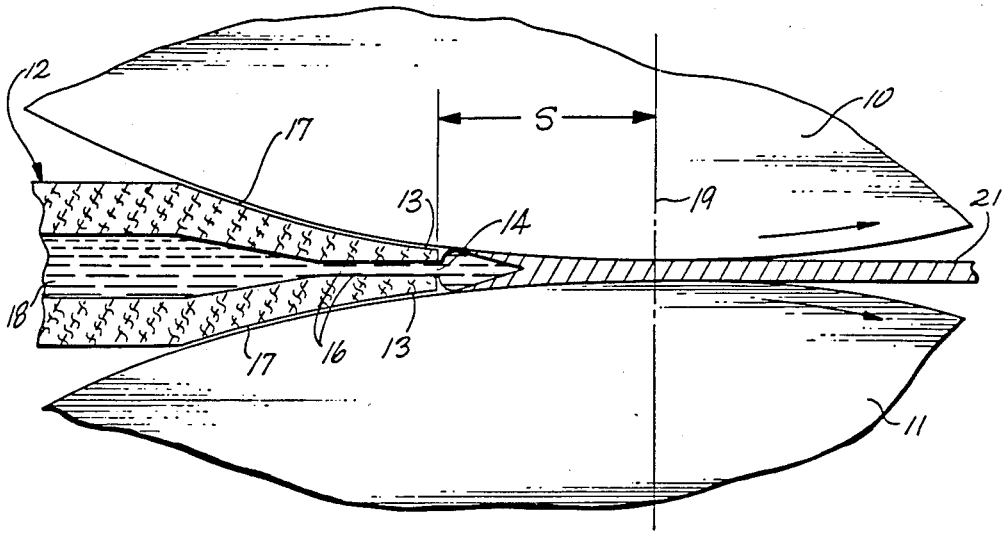
FIG. 1 illustrates schematically the introduction of molten metal and withdrawal of cast sheet in a roll caster.

FIG. 1 illustrates schematically in transverse cross section a fragment of an exemplary horizontal roll caster. It will be understood that in this drawing the aforementioned 15° tilt is not illustrated merely for convenience in drafting. Thus, in the drawing the upper roll 10 is illustrated as directly above the lower roll 11. During use, the rolls are rotated at a selected speed in the direction of the arrows. A pouring tip 12 is positioned between the rolls on the entrance side of the nip between the rolls. The pouring tip 12 is positioned between the rolls on the entrance side of the nip between the rolls. The pouring tip is made of a ceramic insulating material such as Marinate or a fibrous material as described in U.S. Pat. Nos. 4,232,804 and 4,303,181. The pouring tip comprises, in effect, a pair of parallel, spaced-apart slabs of such material extending in the direction of the length of the rolls, a distance corresponding to the width of the sheet to be cast. For example, if it is desired to cast a sheet 1.2 meters wide the inside length of the pouring tip would be about 1.2 meters.

The front of the pouring tip has a pair of lips 13 spaced apart to define a tip orifice 14 therebetween. Inside the pouring tip the walls 16 are parallel to each other for a distance rearwardly from the lips. On the outside the pouring tip has curved faces 17 with a curvature about the same as the curvature of the adjacent faces of the rolls 10 and 11. At a location rearwardly from the lips of the pouring tip where the wall thickness is increased to provide a desired strength, the interior walls of the casting tip diverge toward an interior plenum 18. Additional details of a casting tip suitable for use in practice of this invention are described hereinafter in relation to FIGS. 4 and 5.

The front of the pouring tip is inserted into the space between the rolls so that the lips are a specified distance from the central plane 19 that includes the axes of the rolls. It is, of course, at this plane that the spacing distance between the rolls is at a minimum. The distances from the central plane to the nearest edge of the lips 13 on the pouring tip is referred to as the setback.

During operation of the caster, molten aluminum alloy is fed from a headbox (not shown) to the rear of the pouring tip. The molten metal passes through the interior plenum 18 and out of the orifice 14 into the space between the rolls. When the metal contacts the water-cooled rolls, freezing occurs and solidification progresses from the roll surfaces toward the center of the metal. In an exemplary casting operation solidification is complete before the advancing metal reaches the center plane of the mill and some hot working of the solidified metal occurs as the metal advances toward the center plane of the rolls. The cast sheet 21 is withdrawn from the exit side of the rolls.

Molten metal exiting from the orifice of the pouring tip advances to the moving roll surfaces in an envelope of a thin oxide film that forms on the molten metal surface. Hence, the lips need not contact the roll surfaces, and in fact a small space exists between the lip and the roll to avoid wear of the tip.

A broad variety of casting parameters have been employed in the past, but no combination of the conventional parameters proved satisfactory for casting the magnesium bearing alloy used for computer memory disks. Previously, attempts have been made to cast this alloy with a conventional cast sheet thickness of about 7.7 millimeters and a casting speed of about 0.58 meters per minute, or a production rate of about 710 kilograms per meter of width per hour. The quality of the product has been quite poor, with excessive surface ripple, shiny spots after anodizing, and inclusions that cause surface roughness and dropouts in recording film.

These casting parameters are about the same as used for a variety of other alloys used for a variety of purposes. Commercially pure aluminum can be cast at rates as high as 1.5 meters per minute, but much lower casting rates are required for alloys. Commercial casting of aluminum alloy sheets is typically in the thickness range of 7 millimeters or more. Some alloys have been cast as thin as 6 millimeters.

Generally speaking pure aluminum can be cast at a high rate since it has a sharp melting point. Alloys must be cast at a lower rate since there is often a substantial difference between the liquidus and solidus, and controlled freezing is important. Alloys are often more difficult to cast because of alloy segregation between the surface and center of the sheet. Other problems may be caused by hot working an alloy sheet between the locus of solidification and the minimum clearance between the casting rolls.

It is found in practice of this invention that satisfactory quality can be consistently obtained when casting aluminum alloys having more than about 2% total alloying elements when the thickness of the cast sheet is in the range of from 4 to 5.8 millimeters and casting rates are in the range of from 1.3 to 1.9 meters per minutes. Higher casting speeds can be used when careful control is maintained. For example, a magnesium containing alloy has been cast as fast as 2.1 meters per minute. Increasing the thickness and decreasing casting speed to conventional ranges results in surface ripple and other objectionable defects. Increasing casting speed without decreasing thickness may yield incomplete solidification and severe defects. Decreasing thickness without increasing casting speed can lead to premature solidification and excessive hot working. The separating force between the rolls also increases as the thickness is decreased and high bearing loads can result.

It is found that a combination of casting speed in the range of from, 1.3 to 1.9 meters per minute and a sheet thickness of 4 to 5.8 millimeters is important for reliably and reproducibly obtaining cast sheet of aluminum alloy with minimal surface and internal defects.

If the casting speed is less than 1.3 meters per minute, the desired microstructural refinement from rapid solidification seems to be lost for most alloys. If the casting speed is more than 1.9 meters per minute the ability to control the caster is jeopardized. Caster control is based on control of current to run the caster. There is minimum current required to run the caster without any metal being cast. When metal is being cast, the sheet is conveyed to a coiler which is driven to apply a tension to the sheet to cinch it tightly onto the coil being formed. Such tension is also important to prevent sticking of the sheet onto the rolls of the caster. When the casting speed is more than 1.9 meters per minute, the tension on the sheet approximately balances the retarding forces due to rolling solidified metal in the nip of the rolls, and the current required to run the caster is about the same as when no metal is being cast. This makes reliable control difficult.

Excellent quality can reliably be obtained by casting sheet in a thickness in the range of from 4 to 5 millimeters at casting speeds of 1.5 to 1.8 meters per minute. A production rate of 1000 kilograms per meter of width per hour or more is readily obtained. By going to such thinner sheet and higher casting speeds, productivity has been increased by as much as 50% and objectionable surface ripple has disappeared. These ranges are preferred because of the enhanced reliability and ease of control of the casting process.

When the casting speed is at least 1.5 meters per minute good microstructural refinement is obtained and it is preferred to assure such refinement for alloys by casting at a speed at lest this high. It is preferred that the maximum casting speed be about 1.8 meters per minute since this allows some perturbations in casting conditions (e.g., change in headbox temperature) without degrading quality of the cast sheet. In other words, some leeway in control of casting conditions is available and at higher speeds the caster is not as tolerant of variations.

The aforementioned casting speeds are appropriate for casting rolls having a diameter of about one meter. Roll casters for aluminum have been built with roll diameter from about $\frac{2}{3}$ meter to about 1.5 meter. Suitable adjustments in casting speed are made for these larger and smaller machines. Casting speeds are generally lower for smaller diameter rolls and higher for larger diameter rolls to obtain equivalent results.

Preferably cast sheet thickness is at least 4 mm. so that the sheet can be subjected to some cold work for finishing the disk stock with fine grain size. Further, if the thickness is less than four millimeters, the orifice of the ceramic casting tip becomes so small that starting molten metal flow becomes quite difficult. For reasons not fully understood, it is quite difficult to obtain consistently good quality in the cast sheet when the thickness is more than 5.8 mm.

It is particularly preferred that the magnesium containing aluminum alloy sheet to be used as stock for making magnetic recording disks be cast in a thickness in the range of from 4 to 5 millimeters at a casting speed of from 1.3 to 1.8 meters per minute.

At high casting speeds there is rapid solidification. Cooling rates may be in excess of 1000° C. per second (as compared with about 300° C. per second in conventional continuous casting) which considerably refines the particle size of intermetallic compounds and virtually suppresses formation of such particles in the surface layers. Rapid solidification technology refers to processes where the cooling rate is in excess of 1000° C. per second. New metallurgical phenomena occur and in the aluminum alloys non-equilibrium phases may occur. It is not known exactly what microstructural phenomena are occurring but it is known that excellent memory disks can be made from sheet cast at thicknesses less than and speeds greater than conventional practice. The high speed of the casting process also almost completely eliminates temperature fluctuations during solidification, thereby avoiding the heterogeneity associated with surface ripples and ameliorating need for subsequent homogenization heat treatment.

It has often been a characteristic of a cast aluminum sheet from a continuous roll caster, particularly with alloys having more than about 2% total alloying elements that there is a repetitive heterogeneity that manifests itself as a series of ripples perpendicular to the casting direction. The severity of these ripples varies with the alloy being cast. In many alloys, the ripple may be sufficiently severe that it leaves a "zebra stripe" appearance on finished products.

Such ripple is largely avoided in practice of this invention. Surface solidification of the cast sheet progresses without remelting by heat transferred from the solidifying center of the strip. A balance of casting speed and sheet gauge to achieve the desired result is important. Sheet thickness in the range of from 4 to 5.8 millimeters is cast with a speed more than about 7.3 meters per minute and preferably in the range of from 1.3 to 1.9 meters per minute. Preferably sheet thickness is less than 5 millimeters and casting speed is in the range of from 1.5 to 1.8 meters per minute. Other parameters that help achieve a ripple-free casting include the casting temperature, tip design, setback, and metal head.

Although the reasons for ripple may not be fully understood, a reasonable hypothesis can be stated. In a paper entitled "A Steady State Model for Roll Casting" presented at a Conference on Materials Casting at Santa Barbara, Ca., in Jan. 1986, M. J. Bagshaw, J. D. Hunt, and R. M. Jordan postulate three different heat transfer regions as metal solidifies in a roll caster. Heat is removed from the sheet by the roll along the sheet roll contact length at a rate characterized by a heat transfer coefficient. This coefficient varies along the contact length as the sheet passes between the rolls.

It is postulated that initially there is a region of relatively high heat transfer coefficient along the region of the contact length corresponding to the intimate contact of the molten metal with the roll. This is followed by a second region of lower heat transfer coefficient due to shrinkage and bucking of the sheet away from the roll. Finally, as more solid forms at the center of the sheet and the alloy gains in strength in the center, a greater pressure is exerted by the rolls, on the sheet, thus obtaining intimate contact once again and achieving a higher heat transfer in a third region. These authors postulate heat transfer coefficients in these three regions as 3.53, 0.105, and 20.0 $J/cm^2s°$ C. These authors conclude that "heat lines", regions of extremely bad surface extending along the length of the sheet may result when the casting speed is increased above the usually acceptable limits.

In that paper experimental sheet exit temperatures were reported as a function of casting speed. The highest recorded speed for each alloy was very close to the speed at which heat line formation first occurs, i.e., a practical speed limit. The cast strip thickness was about six millimeters and the maximum speeds recorded were less than 0.84 meters per minute, except for commercially pure aluminum and alloy 8006 which contains 1.2 to 2.0% iron, 0.3 to 1.0% manganese and up to 0.4% silicon. The maximum casting speed recorded for that alloy was less than 1.14 meters per minute. There was one test of alloy AA-1100, which is a minimum of 99% aluminum, at a casting speed of less than 1.44 meters per minute.

We believe that ripple may occur as a consequence of the differing heat transfer coefficient between the first two postulated regions. In the first region the surface of the metal being cast solidifies as heat is rapidly extracted by the rolls. The remaining molten metal has appreciable latent heat of fusion. When the metal enters the second region with low heat transfer coefficient, heat transferred from the center of the sheet may remelt surface metal, particularly that portion with compositions near the solidus, such as in grain boundaries. The remelted metal has low strength, and since there has been an opportunity for oxidation of the metal after leaving the casting tip, some of the oxidized surface material may be preferentially transferred to the roll surface. Any such material transfer would be minute.

Thereafter, when the caster roll has made a full revolution any residual transferred material adhering to the roll intervenes between the roll and the sheet being cast. This results in still lower heat transfer coefficient in both the first and second regions, and more extensive remelting. Minute variations in heat transfer coefficient can thereby be reinforced as remelting is exacerbated by oxidation products adhering to the roll in some areas, while other areas retain a somewhat higher heat transfer coefficient. The accuracy of such a model is supported by the observation that ordered nonuniform deposits can be seen on a used caster roll which produces sheet having surface ripple. Such observations led to the attempts to avoid ripple by wire brushing the rolls.

It is believed that in practice of this invention a sufficiently high cooling rate is achieved with the thinner sheet and faster casting speed that remelting of the surface in the postulated second region is avoided. The enhanced surface strength helps avoid accumulations of contamination on the roll surface by retaining any oxidation products on the cast sheet.

The ripple on the sheet surface is believed to be a consequence of the nonuniform cooling and freezing and the resultant strength variations of the sheet as it is deformed in the nip of the rolls. By significantly reducing sheet thickness and increasing casting speed, remelting is avoided, accumulation of oxidation products on the roll is minimized, uniform cooling is promoted, and ripple-free sheet is obtained. As a substantial additional benefit, the production rate of cast sheet is increased by as much as 50%. The high speed cooling also helps avoid segregation in the higher alloy content materials and yields a fine grain structure with small dendritic arm spacing.

Problems with high speed casting in the past have included sticking of the cast sheet to the roll surface, resulting in severe damage to the cast sheet, often making it completely unusable. Since it has been believed necessary to run the casting machine slowly to avoid sticking, relatively thick sheets (typically from 7 to 10 millimeters) have been cast to obtain a production rate as high as possible. Thick sheets can be accommodated in conventional casting because the longer time of the sheet in contact with the rolls can result in sufficient cooling to produce a completely solid sheet at or before the nip of the rolls.

There are several additional benefits from casting much thinner sheet than previously believed feasible for aluminum alloys. The cast sheet is typically wound into a coil as it comes out of the caster. The coiling machine, shears, and other sheet handling equipment must be heavier and, hence, more expensive for handling conventional thick sheet than the thinner sheet provided in practice of this invention. Later the sheet is unwound from the coil and rolled to the desired thickness for a finished product. This equipment must also be heavier and more expensive. The amount of final thickness reduction can also be minimized in practice of this invention, thereby reducing subsequent processing costs. Segregation of alloying elements in sheet cooled with rapid solidification technology may be so much reduced that a costly homogenization heat treatment is avoided. Most significant are suppression of ripple and increased production.

The temperature of the molten metal should be sufficiently above the liquidus temperature to avoid premature solidification in the casting tip and may differ somewhat depending on heat losses in the pouring tip, casting rate, gauge of the cast strip, etc. Temperature is typically measured in the headbox or tundish that feeds molten metal to the pouring tip. For a 5082, 5086 or 5182 alloy, temperature in the headbox is preferably in the range of from 675° to 725°. If temperature is too low, small areas of solidification may occur in the casting tip, leading to imperfections in the cast sheet. If the molten metal temperature is too high, the metal may not completely solidify between the rolls and the cast sheet is defective. In a process as herein described the temperature of the molten aluminum alloy is preferably held about 20° above the liquidus temperature of the alloy, or 680° to 690° C. for the 5086 alloy, for example.

The level of liquid metal in the headbox is preferably maintained at an elevation in the range of from −4 to +22 millimeters from the elevation of the intersection of the centerline of the pouring tip with the center plane of the rolls. Since the preferred caster is tilted backwards about 15°, this intersection is at a higher elevation than the end of the tip. If the head is more than 22 mm, smooth flow of metal from the tip to the rolls may be disrupted and surface irregularities may result. A slight negative head can be maintained since metal is continually withdrawn from the nip of the casting rolls. Preferably a head of about +1 millimeter is maintained above the tip.

It has been found quite significant to maintain a very low level of insoluble inclusions in the alloy being cast. An inclusion level of less than 0.008% by weight should be maintained for casting disk stock for making magnetic memories. Cleanliness and filtering the molten alloy are keys for maintaining a low inclusion level in the cast sheet. The design of the pouring tip is also significant with respect to preventing inclusions.

An aluminum alloy preferred for casting disk stock in practice of this invention is similar to alloy 5086. The magnesium content is in the range of from 2 to 5% by weight. At least 2% magnesium needs to be present to impart the necessary mechanical strength in the fully annealed disk substrate. Additions of magnesium in excess of 5% may cause excessive oxidation of the melt and preferably are avoided. Preferably the manganese content is in the range of from 0.07 to 0.15%, however, minor excursions outside these limits may be acceptable. It is preferable that the manganese content be at least 0.07% to increase the mechanical strength, modulus, and corrosion resistance of the substrate. It is preferable that the manganese content be less than about 0.15% by weight to minimize segregation due to formation of Al-Fe-Mn intermetallic compounds.

Iron and silicon are usually present as impurities and tend to aggravate centerline segregation in the cast strip. The iron and silicon content should be held below 0.2% each to minimize segregation that may perturb subcutaneous magnetic characteristics of the substrate.

Chromium in the range of from 0.05 to 0.10% by weight may be beneficial for grain size control during annealing. This has not proved to be a critical parameter and lower chromium levels can be acceptable. Amounts of chromium substantially above the preferred range are not recommended since chromium contents in excess of about 0.35% tend to promote growth of large intermetallic particles.

Lithium and beryllium may be employed to retard oxidation of the molten alloy. These materials aid in maintenance of a continuous tough oxide skin on the melt. It is therefore desirable to include these elements in the range of up to 0.04%A by weight. It is believed that such additions of lithium and beryllium tend to decrease the formation of non, metallic inclusions.

Small amounts of calcium may be included in the composition to control dendritic segregation, although in the high speed casting process, this use appears to be optional. The calcium, content is preferably less than about 0.05% by weight. Small additions of strontium may refine intermetallic particle size. The high cooling rate in this process, however, tends to render such additions virtually unnecessary. Preferably the strontium content is less than about 0.05% by weight.

Hydrogen in the melt should also be kept to a minimum. Its presence can cause porosity in the cast sheet and it may also progressively accumulate within the pouring tip, eventually causing a disturbance of the metal flow. It is therefore preferred that hydrogen be kept below 0.2 PPM and it is particularly preferred that hydrogen be kept below 0.1 PPM when several days of continuous operation are desired.

Addition of a grain refiner appears beneficial in suppressing segregation. In an exemplary embodiment the grain refiner contains both titanium and boron. The exact composition of the grain refining addition is not of particular importance. It is preferable that the grain refining addition activate before reaching the point where solidification occurs and remains active through solidification. The grain refining addition should not introduce particles that rapidly cluster or settle in the molten alloy. Preferably an aluminum-titanium-boron master alloy wire is added to the melt just before the caster to act as a grain refiner. The addition rate of grain refiner may be determined by grain size evaluations of the cast strip or by test castings of the melt taken immediately prior to entering the casting machine. The preferred addition rate is that at which further increases in the addition rate of grain refiner case no significant further decrease in grain size.

The high speed thin gauge casting process provided in practice of this invention is so tolerant of alloy chemistry that acceptable quality disk stock has been produced with no additions of grain refiner. Moderate variation of the content of other alloying ingredients and some tolerance of impurities are also hallmarks of the high speed casting process.

Figure 2:
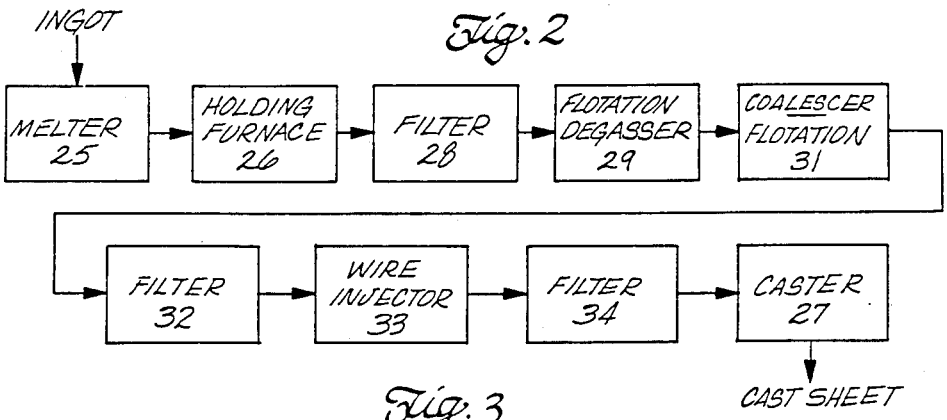
FIG. 2 is a block diagram of a casting system.

FIG. 2 illustrates in block diagram the preparation of metal for casting. Due to the demanding nature of disk stock, it is important that non-metallic inclusions be kept to a minimum. They can be deleterious in a number of ways, not the least of which is that such particles can be carried through in the molten metal, resulting in a defect in the substrate surface. Non-metallics can disrupt the casting process by acting as nucleation sites for premature solidification, thus disturbing microstructure of the disk stock. Thus, a careful metal preparation is important. Ingots of metal are melted in a melter 25 and the molten metal is passed through a series of cleaning steps before reaching the caster 27 which produces the final cast sheet. The individual components, with exception of a coalescer, are conventional in that they are commercially available, but so far as is known they have not been employed as described herein.

The melting furnace is kept thoroughly clean and is regularly drained and cleaned to avoid accumulations of insoluble material that might be carried through the system with the molten metal to appear in the cast sheet. It is preferable to form the desired alloys by melting 99.98% pure aluminum ingots plus suitable master alloys to minimize contamination. Recycled scrap is preferably avoided. The melt is continuously covered by a suitable flux such as a conventional mixture of chloride and fluoride salts. The melt in the furnace is skimmed to remove insolubles and chlorine or an argon-chlorine mixture may be bubbled through the melt to help remove metallic and non-metallic impurities and reduce dissolved hydrogen. Further, beryllium or lithium master alloy may be added to the melt to assist in deoxidation.

Since the caster may operate continuously for several days, additional alloy is melted in the melting furnace. The molten metal is transferred to a holding furnace 26 when the melt chemistry has been verified, so as to maintain a steady supply of molten metal for the caster. Fluxing is continued to the holding furnace.

Enroute to the caster the molten metal is passed through a ceramic foam filter 28 having about 30 pores per inch for minimizing oxide particles in the melt. The filtered metal then goes to a spinning nozzle inert flotation filter 39, commonly referred to as a SNIF unit. A nozzle in the SNIF unit is rotated at about 350 RPM to sparge a mixture of argon and chlorine into the metal. About 2.5 $Nm^3/hr$ of high purity argon with about 0.015 $Nm^3/hr$ of chlorine is injected into the molten metal. Very fine bubbles of gas ascending through the molten metal tend to sweep solid particles to the surface and remove dissolved hydrogen or other gases. The chlorine combines with some impurities and the resultant chlorides tend to float out as well.

The degassed metal from the SNIF unit 29 is then passed through a coalescer 31. The purpose of the coalescer is to coalesce extremely fine droplets of molten chlorides in the metal to form larger droplets which float from the melt. The chlorine sparged into the molten metal in the SNIF unit reacts with metals in melt to produce primarily magnesium chloride, but also chlorides of sodium, potassium lithium, and calcium which are impurities to be removed. These liquid chlorides pass through ceramic filters with great ease and tend to carry oxide particles through such filters as well. Thus, the filters are ineffective and oxide particles may appear as inclusions in the cast sheet. Removal of such chlorides prior to filtration is therefore desirable, if not essential.

The chloride droplets downstream from the SNIF unit are too small to float out in a reasonable time. Techniques have therefore been proposed for coalescing these particles, but without successful commercial implementation. For example, one such coalescer described in U.S. Pat. No. 4,390,364, employs a very large "box" having inclined plates from 12 to 50 millimeters apart between which the molten metal flows. Although coalescence can be achieved in such a unit, its very large size has made it unacceptable and such units are not in industrial use.

Figure 3:
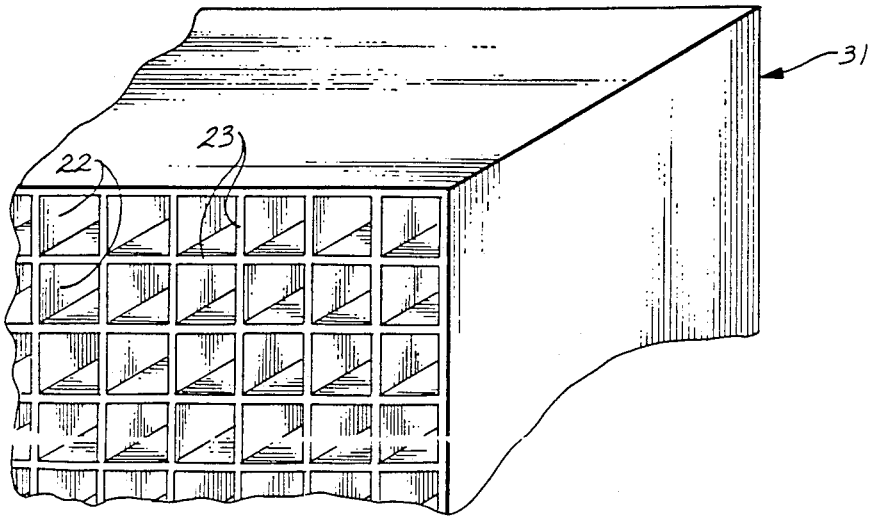
FIG. 3 is a fragmentary perspective view of one corner of an exemplary coalescer for molten aluminum alloy.

The preferred coalescer 31 employed in practice of this invention comprises an extended "honeycomb" of rigid ceramic such as alumina, mullite, or other inert ceramic, 50 by 100 millimeters wide in the direction transverse to liquid metal flow and having a thickness of 12 to 15 millimeters in the direction of metal flow. The honeycomb chosen is extruded with square "honeycomb" cells 22 extending in the direction of thickness of the coalescer as illustrated in the fragmentary view of a corner of such a coalescer in FIG. 3. Each cell opening is two millimeters by two millimeters with a thin wall 23 between adjacent openings. Thus, the aluminum alloy flows through a plurality of parallel passages two millimeters square and twelve to fifteen millimeters long. In an exemplary embodiment about 1000 kilograms of alloy per hour is passed through such a coalescer, 50 millimeters by 100 millimeters and having almost 1000 such passages. It is found that such a coalescer is extremely effective in causing coalescence of the chloride droplets which float out so that a filter downstream from the coalescer effectively removes oxide particles.

The extruded ceramic honeycomb employed in the coalescer was originally developed to serve as a substrate in automotive exhaust catalytic converters. It is also used for filtering cast iron as it is poured into a mold. Such material is commercially available from a variety of vendors, including Ringold Ceramics, Corning Glass, Foseco and others, and in a variety of ceramic materials. It is available in a variety of cell geometries, including hexagons, squares, and triangles, and in a variety of cell sizes and lengths.

It is preferred to employ a coalescer having a cell opening in the range of from 0.5 to 5 millimeters and a length in the range of from 5 to 50 millimeters for coalescing chloride droplets. Preferably the length of the passages through the honeycomb are in the range of from four to ten times the width of the passage to assure that the liquid droplets have sufficient residence time in the coalescer to approach a wall of the coalescer and contact other droplets. Thus, the dimensions of the coalescer are in part determined by the flow rate of metal. It has been calculated that flow through the narrow passages is laminar with a Reynolds number of about 200. The extremely low flow rate and Reynolds number through the coalescer explain the great effectiveness of the preferred embodiment with two millimeter wide passages only twelve millimeters long. the molten aluminum does not readily wet the ceramic and must be urged through the passages to get flow through the coalescer started. Typically the coalescer can be started by heating it to somewhat higher than the casting temperature of the aluminum, applying molten aluminum to one face of the honeycomb and vibrating the honeycomb to initiate flow through it.

If the honeycomb passages are significantly smaller than 0.5 millimeters, difficulty in starting flow of molten aluminum through the coalescer may be encountered. If the passages are significantly larger than five millimeters, adequate coalescence to remove sufficient chlorides for good filtration may not be obtained. If the passages are shorter than about five millimeters, residence time of alloy in the coalescer may be too short to provide adequate coalescence. If the passages through the honeycomb are significantly longer than 50 millimeters, starting flow through the coalescer is more difficult. Long lengths have not proved necessary since excellent coalescence is obtained with a flow through only 12 to 15 millimeters of coalescer. The dimensions of the coalescer are chosen to be large enough to avoid plugging by occasional large particles of oxide that may be present in the melt and to minimize head loss in the coalescer. The furnace and caster are ordinarily arranged with a fall or decrease in height of only about 1% in the trough between the furnace and the headbox. Substantial obstruction by the coalescer is therefore to be avoided. The short narrow passages in the preferred embodiment have negligible head loss.

The coalescer is preferably tilted so that the molten metal flows downwardly through it at an angle of up to 45° from the horizontal. This helps assure that coalesced droplets float out on the upstream face of the coalescer and is believed to improve chloride removal. Good coalescence and removal have been obtained with the coalescer passages horizontal, or even tilted upwardly so that droplets float out on the downstream side of the coalescer. The coalescer is positioned in a flow trough downstream from the SNIF or other unit for sparging chlorine containing gas in the melt and is completely immersed in the liquid metal. A baffle above the coalescer assures that metal passes through the coalescer only from the portion of the trough below the floating oxide film.

After flotation of coalesced chloride droplets, any remaining oxides are removed by passing the molten metal through a rigid, porous medium filter 32. An exemplary filter is made of sintered silicon carbide grit which is highly effective for removing fine particles form molten aluminum. A typical filter has a first layer of sintered six mesh grit and a second layer of eight mesh grit. The coarser grit side of the filter is placed upstream so that coarser particles are removed first, followed by removal of finer particles in the pores of the smaller grit size layer of the filter.

Downstream from the final ceramic filter a grain refining wire is introduced by a wire injector 33. An exemplary grain refiner comprises aluminum wire containing about 5% by weight titanium and 0.2% by weight boron. The boron content can be as much as 1% by weight. Sufficient grain refining alloy is added to bring the titanium content up to about 0.02% by weight. It is found desirable to inject the grain refining wire downstream from the sintered silicon carbide grit filter to avoid removal of titanium boride by the very effective filter. A pair of woven ceramic fiber filter trough "socks" 34 in series are used just prior to the molten metal entering the casting machine for removing any oxide particles entrained into the melt by the grain refining wire.

The molten aluminum alloy then passes into the pouring tip of the casting machine. It is found that careful attention should be given to the pouring tip for practice of this invention. The high speed casting process is particularly sensitive to any disruption of flow within the pouring tip. Any accumulation of non-metallic inclusions can disturb the planar, non-turbulent flow exiting the tip orifice. Smooth flow is important for producing a homogeneous cast strip. Thus, it is important to minimize inclusions in the molten alloy and to avoid accumulation of inclusions in the pouring tip.

Figure 4:
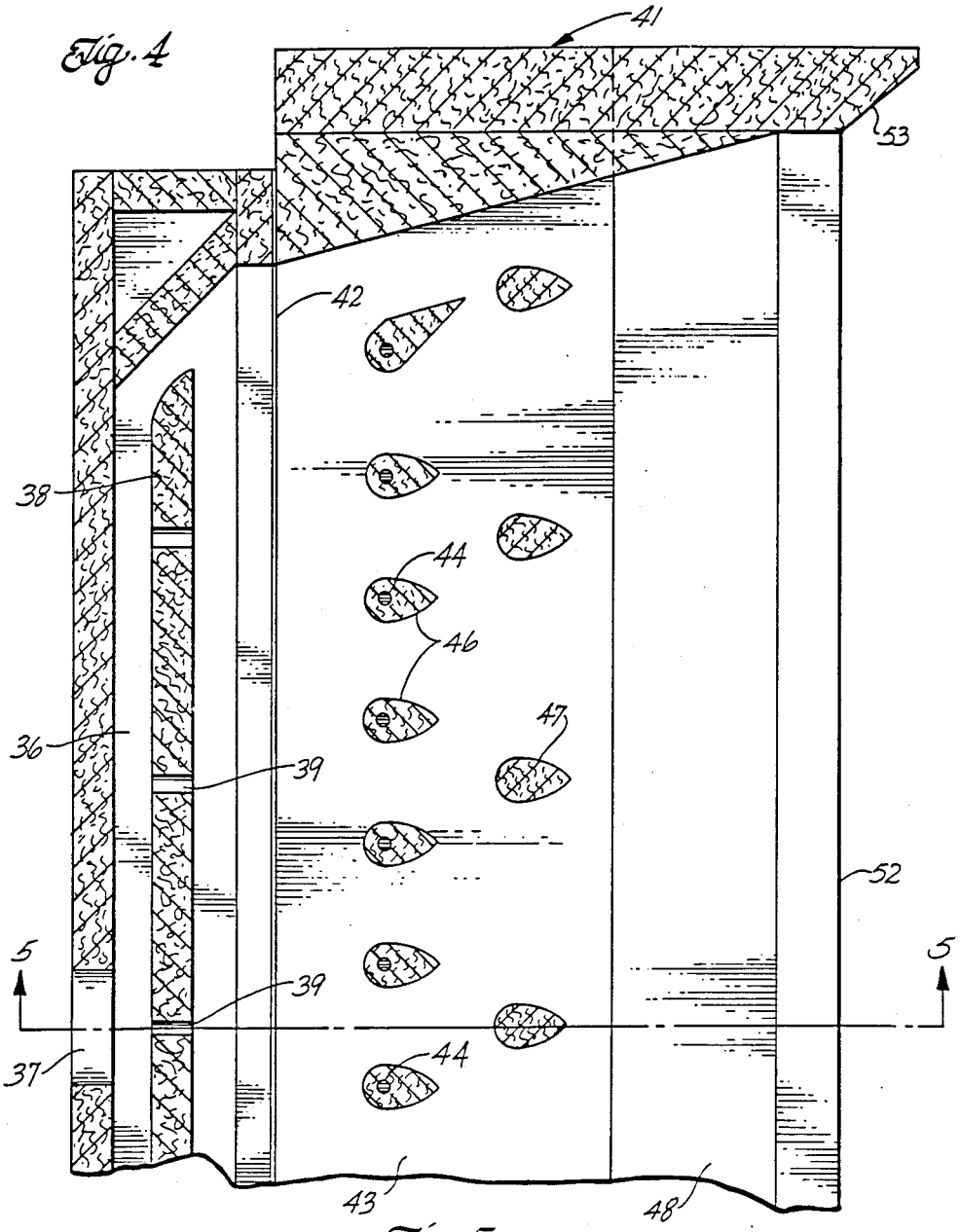
FIG. 4 is a longitudinal cross section of a pouring tip for use in a roll caster.
Figure 5:
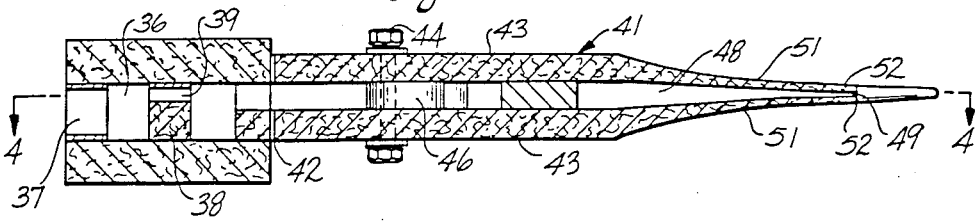
FIG. 5 is another transverse cross section of the caster tip at line 5—5 of FIG. 4.

FIGS. 4 and 5 illustrate an exemplary casting tip made to be used in practice of this invention. FIG. 4 is a longitudinal cross section of the casting tip taken along line 4—4 in FIG. 5 in the direction of the width of the cast sheet. Only a little more than half of the tip is illustrated in FIG. 4. The other half being the same as the part illustrated. FIG. 5 is a transverse cross section perpendicular to the center plane of the casting machine.

As mentioned above, such a pouring tip can be made of Marinite or a rigid ceramic fiber as described in the aforementioned patents, or other insulating material with good dimensional stability and durability. Molten metal enters a distribution plenum 36 at the rear of the pouring tip through a central opening 37 connected to the headbox. A baffle 38 extends across the plenum and has a plurality of holes 39 through which metal passes enroute to the tip. The holes are smaller near the center of the pouring tip and become increasingly larger toward the edges to assure metal distribution across the full width of the pouring tip. The pouring tip 41 is sealed to the plenum chamber by a thin gasket 42.

The feed tip 41 is assembled from two long, more or less flat, slabs 43 of Marinite or rigidized ceramic fiber. These slabs are secured together by bolts 44 passing through upstream spacers 46 between the two slabs. The upstream spacers are in a row parallel to the plenum. A second row of downstream spacers 47 between the slabs hold an upstream portion of the slabs parallel to each other.

Each of the spacers has a teardrop shape with the tail pointing downstream. This shape is employed to minimize turbulence in the metal flowing through the tip. It has been found that solid inclusions tend to accumulate in the wake of spacer or other baffle in the tip and when a sufficient quantity of such insolubles accumulate, they may break away and appear in the cast sheet. Such accumulations of solids in the tip may, in an aggravated situation, result in partial plugging of the tip and require shutdown of the caster due to defective sheet. It is also significant that the number of spacers in the tip is minimized so as to have only enough spacers to maintain the structural integrity of the tip. This reduces the local velocity of the molten metal, thereby reducing turbulence.

The spacers 46 and 47 are in an upstream portion of the tip where the inside walls are parallel to each other. Downstream from this portion there is a tapered portion 48 where the walls converge. Still further downstream, the inside faces of the walls are again parallel to each other in the region immediately upstream from the orifice 49 through which the metal flows into the space between the rolls.

The exterior faces of the slabs 43 are parallel to each other in the upstream portion. Toward the downstream portion there is an arcuate face 51 on each slab to provide clearance from the rolls when the tip is inserted into the gap between them. The exterior arcuate face 51 converges toward the inside face of each slab to leave a thin lip 52 on each slab along the orifice 49. Preferably the inside of the lips adjacent the orifice have a small bevel (not shown) to minimize abrupt changes in the direction of metal flow and minimize defects due to tip erosion. Molten metal coming out of the orifice between the lips is contained by the adjacent rolls. At each end of the pouring tip there is a short wing 53 which prevents metal from flowing longitudinally along the rolls until frozen into the cast sheet.

In an exemplary embodiment the throat of the pouring tip, that is, the distance between the wings at each end, is about 1.2 meters. An exemplary distance from the gasket 42 to the lips 52 is about 35 centimeters. The width of the upstream portion of the interior of the tip where the spacers 46 and 47 are located may be about 18 millimeters. Such dimensions are in the range of conventional practice.

A portion of the tip that is not conventional is adjacent the orifice 49 through which the molten metal is cast toward the rolls. It is preferred that the width of the orifice be in the range of from 50 to 130 percent of the thickness of the sheet being cast. Thus, in an exemplary embodiment the width of the orifice is five millimeters for casting sheet having thickness in the range of from 4 to 5 millimeters. Preferably the width of the tip orifice is in the range of 100 to 110% of the thickness of the sheet being cast.

It is significant that the thickness of the lip 52 on each slab is less than two millimeters, as contrasted with a thickness of about 4 millimeters in conventional practice. A thin lip is important even though structurally fragile so that a minimal setback between the orifice and the center plane of the rolls can be used. Preferably the tip is set back from the center plane of the rolls in the range of from 35 to 60 millimeters, and preferably in the range of from 45 to 50 millimeters. The spacing between the exterior of the tip and the rolls should be as small as feasible, preferably less than one millimeter and most preferably as little as 0.1 millimeter. Conventional setback in continuous less than one millimeter and most preferably as little as 0.1 millimeter. Conventional setback in continuous casters has been in excess of 60 millimeters and is ordinarily greatly in excess of 60 millimeters.

Tip setback is an important parameter. Increasing the setback increases the area of contact by the roll with the solidifying metal. It also increases the volume of metal being solidified at any instant. Within limits, increasing the setback increases the maximum speed at which "hard" sheet is cast, since there is more mechanical working of the sheet after complete solidification. For thin sheet cast in practice of this invention, however, a large setback is undesirable since it extends the depth of the solidification front.

At large setbacks and high speeds the center of the strip may still be solidifying at the exist of the rolls. This casting condition, in combination with the high metallostatic forces developed in the roll bite, can result in inverse segregation near the surface. It may also increase the tendency of the strip to stick to the casting rolls, leading to severe defects. Reducing the casting speed is no answer since production rate is decreased and roll separating force increased. Setback is a compromise between speed and segregation. Preferably parameters are adjusted so that the extrusion value of the sheet being cast is about 110%, that is the sheet exiting from between the rolls is travelling about 10% faster than the roll surface speed, which is a consequence of hot working the metal after solidification.

EXAMPLE

A molten metal aluminum alloy having the following composition was cast into sheet suitable for high quality disk stock:

| Si | Fe | Cu | Mn | Mg | Cr | Zn | Be | Ti | Al |
|---|---|---|---|---|---|---|---|---|---|
| .10% | .25% | .009% | .13% | 4.01% | .004% | .01% | .003% | .02% | Bal. |

The molten metal was passed through a ceramic foam filter having thirty pores per inch. It was then further purified in a spinning nozzle degassing unit operating with about 2.5 $Nm^3$/hr argon and 0.015 $Nm^3$/hr chlorine with the nozzle rotating at about 350 RPM. The molten metal passed through a honeycomb coalescer and rigid media 6/8 grit ceramic filter as hereinabove described. Sufficient aluminum alloy wire having 5% titanium and 0.2% boron was added as a grain refiner to bring the titanium content up to 0.02%. A woven ceramic fiber trough sock was used to filter the metal just prior to the headbox.

Typical headbox temperature was 685° to 687° C. and a head of metal was maintained five millimeters about the center line of the tip orifice. The tip orifice was 4.3 millimeters high and had a width of 1206 millimeters. The lip thickness was 1.5 millimeters and the lip to roll distance was 0.5 millimeters. A tip setback of 50 millimeters was used. Roll diameter was about one meter. The sheet was cast to a thickness of 4.8 millimeters and a width of 1220 millimeters. The resultant sheet was smooth and free of ripple with a surface substantially free of inclusions and areas of segregation or premature solidification of the alloy in the casting tip.

The sheet was rolled to form disk stock without a homogenization heat treatment. The sheet was rolled in two passes to 3.7 millimeters and 2.7 millimeters, respectively. It was then edge trimmed and annealed at 380° C. for two hours. It was again cold rolled in two passes to 2.12 millimeters and 1.45 millimeters respectively. The edge was again trimmed and the sheet was annealed at 340° C. for two hours. After tension levelling the sheet, circular disk substrates were blanked from the sheet. These disks were thermally flattened and upon inspection found to be satisfactory for forming computer memory disks.

If desired a thermal homogenization treatment may be used on the as cast sheet to eliminate any minor areas of segregation caused by imperfections in the casting conditions. A reason for doing this is to allow the machine operator a somewhat larger margin of variation in casting parameters in a production operation. An exemplary homogenization maintains the temperature of the as cast sheet in the range of 485° to 500° C. for about sixteen hours.

A technique is provided in practice of this invention for production of high quality aluminum alloy sheet by continuous casting. This sheet is cast in thinner gauges than previously considered feasible and with a substantially higher casting speed than previously employed for alloys. In addition to providing sheet with a surface substantially free of ripples, it is found that a production rate increase of almost 50% is obtained. Thus, instead of being a particularly intransigent material to cast continuously, the magnesium bearing alloys can be cast with high quality and substantially higher productivity than ever before obtained.

Although one example of a technique for the casting of aluminum alloys has been described in detail herein, it will be apparent that principles of this invention are applicable to other alloys. Variations in the casting parameters to obtain desired results can also be practiced. For example, when sufficient cold work can be applied to the cast sheet to make a finished product and the cast sheet is narrow enough to facilitate starting the casting process, the cast sheet thickness can be as little as 3 millimeters, and casting speed concomitantly higher. Casting speeds may also be higher when microsegregation is less of a problem than in disk stock. It is therefore to be understood that within the scope of the appended claims, the invention may be practiced otherwise than as specifically described.

What is claimed is:

1. A method for casting an aluminum alloy having more than about two percent of total alloying elements in the aluminum comprising the steps of continuously introducing such molten aluminum alloy through an insulating tip to the nip of rotating rolls and continuously withdrawing a cast sheet from between the rolls and characterized by the thickness of the cast sheet being in the range of 4 to 5.8 millimeters and the casting rate being more than 1.3 meters per minute.

2. A method as recited in claim 1 wherein the thickness of the sheet is no more than five millimeters.

3. A method as recited in claim 2 wherein the casting speed is in the range of from 1.3 to 1.9 meters per minute.

4. A method as recited in claim 1 wherein the casting speed is in the range of from 1.3 to 1.9 meters per minute.

5. A method as recited in claim 1 wherein the casting speed is in the range of from 1.5 to 1.8 meters per minute.

6. A method as recited in claim 1 wherein the aluminum alloy comprises from 2 to 5% by weight magnesium.

7. A method as recited in claim 1 wherein the proportion of particles insoluble in the molten aluminum alloy is reduced to less than 0.008% by weight.

8. A method as recited in claim 7 comprising the steps of coalescing chloride droplets to float from the aluminum alloy, filtering the aluminum alloy for removal of insoluble particles, and thereafter introducing an aluminum alloy wire containing titanium and boron for refining grain size in the cast sheet.

9. A method as recited in claim 1 wherein the setback between the lip of the insulating tip and the center plane of the rolls is in the range of from 35 to 60 millimeters.

10. A method as recited in claim 9 wherein the setback is no more than 50 millimeters.

11. A method as recited in claim 9 wherein the spacing between the lip and the rolls is no more than one millimeter.

12. A method as recited in claim 9 wherein the thickness of the lip is no more than two millimeters.

13. A method as recited in claim 12 wherein the width of the orifice is in the range of from 50 to 130% of the thickness of the sheet being cast.

14. A method as recited in claim 12 wherein the width of the orifice is in the range of from, 100 to 110% of the thickness of the sheet being cast.

15. A method as recited in claim 14 wherein the spacing between the lip and the rolls is no more than one millimeter.

16. A method as recited in claim 9 wherein the head of aluminum alloy relative to the intersection of the center line of the orifice between the lips of the tip and the center plane of the rolls is in the range of −4 to +22 millimeters.

17. A method as recited in claim 16 wherein the head is about +1 millimeter.

18. A method for casting an aluminum alloy including magnesium in the range of from 2 to 5% by weight comprising the steps of continuously introducing molten aluminum alloy through an insulating tip to the nip of rotating rolls and continuously withdrawing a cast sheet from between rolls and characterized by the thickness of the cast sheet being less than 5.8 millimeters and the casting rate being in the range of from 1.3 to 1.9 meters per minute.

19. A method as recited in claim 18 wherein the thickness of the sheet is in the range of from four to five millimeters.

20. A method as recited in claim 19 wherein the casting speed is in the range of from 1.5 to 1.8 meters per minute.

21. A method as recited in claim 18 wherein the setback between the lip of the insulating tip and the center plane of the rolls is in the range of from 35 to 60 millimeters.

22. A method as recited in claim 21 wherein the setback is no more than 50 millimeters.

* * * * *

UNITED STATES PATENT AND TRADEMARK OFFICE

CERTIFICATE OF CORRECTION

PATENT NO. : 4,751,958

DATED : June 21, 1988

INVENTOR(S) : John E. Flowers; Christopher A. Romanowski; Dennis M. Smith

It is certified that error appears in the above-identified patent and that said Letters Patent is hereby corrected as shown below:

On the Front Page

Abstract, line 17, after "much" insert -- as --.

In the Specification:

Column 1, line 7, after "1987" insert -- The subject matter of the prior application is hereby incorporated by reference. --

Column 3, line 3, delete the phrase "which results in heterogeneity".
Column 3, line 28, change "several" to -- severe --.

Column 4, line 10, change "practiced" to -- practice --.
Column 4, lines 42-44, delete the sentence "The pouring tip 12 is positioned between the rolls on the entrance side of the nip between the rolls." (Second occurrence of sentence.)

Column 5, line 61, change "minutes" to -- minute --.

Column 6, line 7, after "from" delete the comma.
Column 6, line 42, change "lest" to -- least --.
Column 6, line 53, change meter" to -- meters --.

Column 7, line 38, change "7.3" to -- 1.3 --.
Column 7, line 62, change "bucking" to -- buckling --.
Column 7, line 65, after "rolls" delete the comma.

UNITED STATES PATENT AND TRADEMARK OFFICE

CERTIFICATE OF CORRECTION

PATENT NO. : 4,751,958

DATED : June 21, 1988

INVENTOR(S) : John E. Flowers; Christopher A. Romanowski; Dennis M. Smith

It is certified that error appears in the above-identified patent and that said Letters Patent is hereby corrected as shown below:

Column 10, line 34, delete "A".
Column 10, line 36, change "non, metallic" to -- nonmetallic --.
Column 10, line 40, after "calcium" delete the comma.

Column 11, line 2, change "case" to -- cause --.

Column 12, line 3, after "potassium" insert a comma.
Column 12, line 68, at the beginning of the sentence change "the" to -- The --.

Column 13, line 51, change "form" to -- from --.

Column 14, line 20, change "FIG. 4. The" to -- FIG. 4, the --.

Column 15, lines 45-47, delete the sentence "Conventional setback in continuous less than one millimeter and most preferably as little as 0.1 millimeter."
Column 15, line 62, change "exist" to -- exit --.

UNITED STATES PATENT AND TRADEMARK OFFICE

CERTIFICATE OF CORRECTION

PATENT NO. : 4,751,958

DATED : June 21, 1988

INVENTOR(S) : John E. Flowers; Christopher A. Romanowski; Dennis M. Smith

It is certified that error appears in the above-identified patent and that said Letters Patent is hereby corrected as shown below:

In the Claims

Column 18, line 18, before "100" delete the comma.

Signed and Sealed this

Third Day of October, 1989

*Attest:*

*Attesting Officer*

DONALD J. QUIGG

*Commissioner of Patents and Trademarks*